US007323631B2

(12) United States Patent
Miyaki et al.

(10) Patent No.: US 7,323,631 B2
(45) Date of Patent: Jan. 29, 2008

(54) INSTRUMENT PERFORMANCE LEARNING APPARATUS USING PITCH AND AMPLITUDE GRAPH DISPLAY

(75) Inventors: Tsuyoshi Miyaki, Hamakita (JP); Hideyuki Masuda, Hamamtsu (JP); Kenichi Miyazawa, Fukuroi (JP); Mari Yana, Tokyo (JP)

(73) Assignee: Yamaha Corporation, Shizuoka-Ken (JP)

( * ) Notice: Subject to any disclaimer, the term of this patent is extended or adjusted under 35 U.S.C. 154(b) by 385 days.

(21) Appl. No.: 11/183,014

(22) Filed: Jul. 15, 2005

(65) Prior Publication Data

US 2006/0011046 A1 Jan. 19, 2006

(30) Foreign Application Priority Data

Jul. 16, 2004 (JP) ..... 2004-210714

(51) Int. Cl.
*G10H 7/00* (2006.01)

(52) U.S. Cl. ..... 84/616; 434/307 A

(58) Field of Classification Search ..... 84/616, 84/654; 434/307 A

See application file for complete search history.

(56) References Cited

U.S. PATENT DOCUMENTS 5,719,344 A * 2/1998 Pawate ..... 84/609
5,804,752 A * 9/1998 Sone et al. ..... 84/610
5,906,494 A * 5/1999 Ogawa et al. ..... 434/307 A
7,164,076 B2 * 1/2007 McHale et al. ..... 84/616

FOREIGN PATENT DOCUMENTS

| | | |
|---|---|---|
| JP | 04-035172 | 3/1992 |
| JP | 08-123454 | 5/1996 |
| JP | 10-069216 | 3/1998 |

* cited by examiner

*Primary Examiner*—Jeffrey Donels
(74) *Attorney, Agent, or Firm*—Harness, Dickey & Pierce, PLC

(57) ABSTRACT

In an instrument performance learning apparatus, a storage section stores model performance waveform data representing a time series of individual performance sounds of a model performance. An input section inputs real performance waveform data representing a time series of individual performance sounds of a real performance. A pitch graph display control section detects each pitch of each individual performance sound from the stored model performance waveform data and from the inputted real performance waveform data, and displays a pitch graph representing transitions of the detected pitches. An amplitude envelope graph display control section detects each amplitude level of each individual performance sound from the model performance waveform data and from the real performance waveform data, and displays an amplitude envelope graph representing transitions of the detected amplitude levels, such that the amplitude envelope graph has a time axis common to that of the pitch graph while the amplitude envelope graph is located in an area of the display device which does not overlap with another area of the display device where the pitch graph is located.

18 Claims, 15 Drawing Sheets

INSTRUMENT PERFORMANCE LEARNING APPARATUS USING PITCH AND AMPLITUDE GRAPH DISPLAY

BACKGROUND OF THE INVENTION

1. Technical Field

This invention relates to an instrument performance learning apparatus.

2. Related Art

Conventionally, attempts have been made to support an improvement of skill in musical expression, which is given through vocals or a musical instrument, by presenting the level of skill in the musical expression using an electronic technique.

For example, the karaoke (sing-along) training machine disclosed in Patent Document 1 evaluates the level of skill in singing sounds by calculating a difference in pitch between vocal sounds of a singer and model vocal sounds. Furthermore, the karaoke machine disclosed in Patent Document 2 makes more reliable evaluations by calculating a difference in volume as well as in pitch. By referencing the evaluations presented by these machines, a singer can objectively grasp his or her skill in singing.

On the other hand, there has also been suggested a technology of supporting an improvement of skill in playing a musical instrument. Patent Document 3 discloses an electronic musical instrument presenting a difference in pitch, length, or velocity between performance sounds input in response to operations of operators and a model melody in the form of a graph. According to the patent document, the electronic musical instrument previously stores performance information representing the pitches, lengths, or velocities of the model melody. With performance sounds given through operations of operators, the electronic musical instrument displays a graph showing the transition of pitches, lengths, or velocities detected from the performance sounds and another graph showing the transition of the pitches, lengths, or velocities of the model melody.

[Patent Document 1] Laid-Open Japanese Patent Publication (Kokai) No. Hei 08-123454

[Patent Document 2] Laid-Open Japanese Patent Publication (Kokai) No. Hei 10-069216

[Patent Document 3] Laid-Open Japanese Utility Model Publication No. Hei 04-035172

As stated hereinabove, the electronic musical instrument disclosed in Patent Document 3 displays both of the graph showing the transition of pitches, lengths, or velocities detected from the performance sounds and the other graph showing the transition of those of the model melody.

The elements determining the level of skill in playing a musical instrument, however, are not limited to the pitch, length, and velocity. For example, only a subtle difference given to the intensity of a single musical sound can create a quite different musical expression as has been proved by an empirical rule. Therefore, you have to admit that this kind of apparatus as disclosed in Patent Document 3 is extremely insufficient for a learner who has a desire to learn also the exquisite musical expression of a model performance.

SUMMARY OF THE INVENTION

In view of this background, the present invention has been provided. Therefore, it is an object of the present invention to provide an instrument performance learning apparatus enabling a learner who plays an instrument to learn contents of exquisite musical expression of a model performance.

According to one aspect of the present invention, there is provided an instrument performance learning apparatus having a display device for displaying a progression of a real performance to enable visual comparison of the real performance with a model performance, the instrument performance learning apparatus comprising: a storage section that stores model performance waveform data representing a time series of individual performance sounds of the model performance; an input section that inputs real performance waveform data representing a time series of individual performance sounds of the real performance; a first graph display control section that detects each pitch of each individual performance sound from the stored model performance waveform data and each pitch of each individual performance sound from the inputted real performance waveform data, and that displays a first graph presenting transitions of the detected pitches of both the real performance waveform data and the model performance waveform data on the display device; and a second graph display control section that detects each characteristic value representing a characteristic of each individual performance sound of the model performance from the model performance waveform data and each characteristic value representing a characteristic of each individual performance sound of the real performance from the real performance waveform data, and that displays a second graph representing transitions of the detected characteristic values of both the model performance waveform data and the real performance waveform data on the display device, such that the second graph has a time axis common to that of the first graph while the second graph is located in an area of the display device which does not overlap with another area of the display device where the first graph is located.

According to another aspect of the present invention, there is provided an instrument performance learning apparatus having a display device for displaying a progression of a real performance to enable visual comparison of the real performance with a model performance, the instrument performance learning apparatus comprising: a storage section that stores model performance waveform data representing a time series of individual performance sounds of the model performance; an input section that inputs real performance waveform data representing a time series of individual performance sounds of the real performance; a pitch graph display control section that detects each pitch of each individual performance sound of the model performance from the stored model performance waveform data and each pitch of each individual performance sound of the real performance from the inputted real performance waveform data, and that displays a pitch graph representing transitions of the pitches detected from both of the model performance waveform data and the real performance waveform data on the display device; and an amplitude envelope graph display control section that detects each amplitude level of each individual performance sound of the model performance from the model performance waveform data and each amplitude level of each individual performance sound of the real performance from the real performance waveform data, and that displays an amplitude envelope graph representing transitions of the amplitude levels detected from both of the model performance waveform data and the real performance waveform data, such that the amplitude envelope graph has a time axis common to that of the pitch graph while the amplitude envelope graph is located in an area of the display device which does not overlap with another area of the display device where the pitch graph is located.

In this aspect, the pitch graph display control section may detect pitches of all or a part of the individual performance sounds of the model performance from the stored model performance waveform data prior to the inputting of the real performance waveform data from the input section, and may previously display a pitch graph representing the transitions of the detected pitches on the display device, while the pitch graph display control section may sequentially detect the pitches of the individual performance sounds of the real performance from the inputted real performance waveform data upon start of the inputting of the real performance waveform data from the input section, and the pitch graph display control section may display another pitch graph representing the transitions of the detected pitches of the individual performance sounds of the real performance on the display device in such a way that said another pitch graph of the real performance is superimposed on said pitch graph of the model performance previously displayed on the display device.

Furthermore, the amplitude envelope graph display control section may detect the amplitude levels of all or a part of the individual performance sounds of the model performance from the model performance waveform data prior to the inputting of the real performance waveform data from the input section, and may previously display an amplitude envelope graph representing the transitions of the detected amplitude levels of the model performance on the display device, while the amplitude envelope graph display control section sequentially detects the amplitude levels of the individual performance sounds of the real performance from the inputted real performance waveform data upon start of the inputting of the real performance waveform data from the input section, and the amplitude envelope graph display control section displays another amplitude envelope graph representing the transitions of the detected amplitude levels of the real performance on the display device in such a way that said another amplitude envelope graph of the real performance is superimposed on the previously displayed amplitude envelope graph of the model performance.

The instrument performance learning apparatus may further comprise a performance portion identifying section that identifies a portion of the model performance waveform data corresponding to a portion of the real performance waveform data inputted from the input section, wherein the pitch graph display control section may detect a pitch from a portion of the real performance waveform data every time a portion of the real performance waveform data is inputted from the input section, the pitch graph display control section also detects a pitch from the corresponding portion of the model performance waveform data identified by the performance portion identifying section, and the pitch graph display control section plots the pitches detected from both of the real performance waveform data and the model performance waveform data in coordinate positions of a given display area of the display device, thereby drawing the pitch graph representing the transitions of the pitches of both the real performance waveform data and the model performance waveform data in the given display area.

The instrument performance learning apparatus may further comprise a performance portion identifying section that identifies a portion of the model performance waveform data corresponding to a portion of the real performance waveform data inputted from the input section, wherein the amplitude envelope graph display control section may detect an amplitude level from a portion of the real performance waveform data every time a portion of the real performance waveform data is inputted from the input section, the amplitude envelope graph display control section also detects an amplitude level from the corresponding portion of the model performance waveform data identified by the performance portion identifying section, and the amplitude envelope graph display control section plots the amplitude levels detected from both of the real performance waveform data and the model performance waveform data in coordinate positions of a given display area of the display device, thereby drawing the amplitude envelope graph representing the transitions of the amplitude levels of both the real performance waveform data and the model performance waveform data in the given display area.

The pitch graph display control section may inhibit a pitch detected from a certain portion of the real performance waveform data from being plotted in the coordinate position of the given display area if the certain portion of the real performance waveform data inputted from the input section meets a predetermined condition.

Moreover, the predetermined condition may be that the amplitude level detected from the certain portion of the input real performance waveform data is lower than a predetermined value.

The predetermined condition may be that no pitch is detected from the certain portion of the inputted real performance waveform data.

The predetermined condition may be that the pitch detected from the certain portion of the inputted real performance waveform data is out of a frequency range associated with a sound name given to the certain portion.

Moreover, the display device may display a piano roll image in the display area for presenting the pitch graph, the piano roll image being composed of a plurality of images of keys vertically arranged as a pitch scale.

The instrument performance learning apparatus may further comprise a parameter storage section that stores parameters defining different display modes of the pitch graph for different types of instruments, a type input section that inputs a type of an instrument to be used in the real performance, and a display mode control section that reads out the parameter associated with the type inputted from the type input section from the parameter storage section and that changes a correspondence between individual keys of the piano roll image and levels of the pitch indicated by the keys according to the parameter read out from the parameter storage section.

The instrument performance learning apparatus may further comprise a parameter storage section that stores parameters defining different pitch detecting characteristics for different types of instruments, a type input section that inputs the type of the instrument used in the real performance, and a detection characteristic control section that reads out the parameter associated with the type which is inputted by the type input section, from the parameter storage section, and that changes the pitch detecting characteristic of the pitch graph display control section according to the parameter read out from the parameter storage section.

According to still another aspect of the present invention, there is provided a machine readable medium for use in a computer which has a display device, a storage device for storing model performance waveform data representing a time series of individual performance sounds of a model performance, and an input device for inputting real performance waveform data representing a time series of individual performance sounds of a real performance, the medium containing a program executable by the computer for carrying out an instrument performance learning method comprising: a pitch graph display control step of detecting pitches of the individual performance sounds from the model performance waveform data and the real performance waveform data, and displaying a pitch graph representing transitions of the pitches detected from both of the model performance waveform data and the real performance waveform data on the display device; and an amplitude envelope graph display control step of detecting amplitude levels of the individual performance sounds from the model performance waveform data and the real performance waveform data, and displaying an amplitude envelope graph representing transitions of the amplitude levels detected from both of the model performance waveform data and the real performance waveform data, such that the amplitude envelope graph has a time axis common to that of the pitch graph while the amplitude envelope graph is located in an area of the display device which does not overlap with another area of the display device where the pitch graph is located.

According to the present invention, the instrument performance learning apparatus can provide a person who wants to acquire skill in playing an instrument by imitating a model performance, with not only a difference in pitch between the model performance and his or her practice performance, but also a difference in other musical elements that cannot be expressed only by pitches. Therefore, the user can improve his or her skill in playing the instrument.

DETAILED DESCRIPTION OF THE INVENTION

First Embodiment

A first embodiment of the present invention will be described below. This embodiment is characterized in that a difference in pitch and amplitude level between a performance of a person who learns instrument performance and a prepared performance as a model is presented in the form of an individual graph.

Hereinafter, the term "learner" means a person who learns skill in playing an instrument by using this system. The term "model performance" means a performance electronically reproduced as a model to be imitated by the learner and the term "real performance" means a performance done by the learner through imitating the model performance. Furthermore, the term "performance elapsed time" means an elapsed time from the start of the model performance or the real performance.

Figure 1:
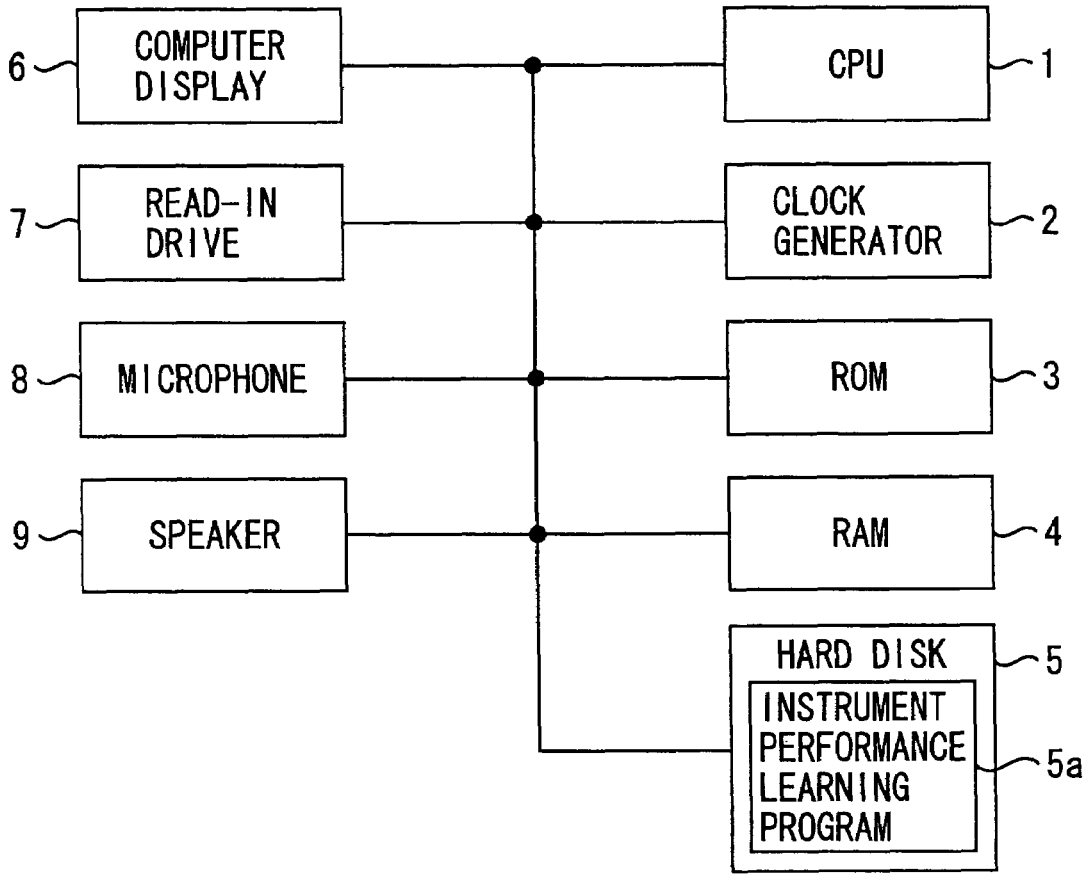
FIG. 1 is a hardware configuration diagram of an inventive instrument performance learning apparatus.

Referring to FIG. 1, there is shown a block diagram illustrating a hardware configuration of an instrument performance learning apparatus according to the first embodiment of the present invention. As shown in FIG. 1, this system comprises a CPU 1 for controlling the operation of the entire system, a clock generator 2, a ROM 3 storing an initial program loader (IPL), a RAM 4 functioning as a work memory, a hard disk 5 storing an operating system (OS) and an instrument performance learning program 5*a*, a computer display 6 for displaying various information, a read-in drive 7 for reading various data from a storage medium, a microphone 8, and a speaker 9.

Figure 2:
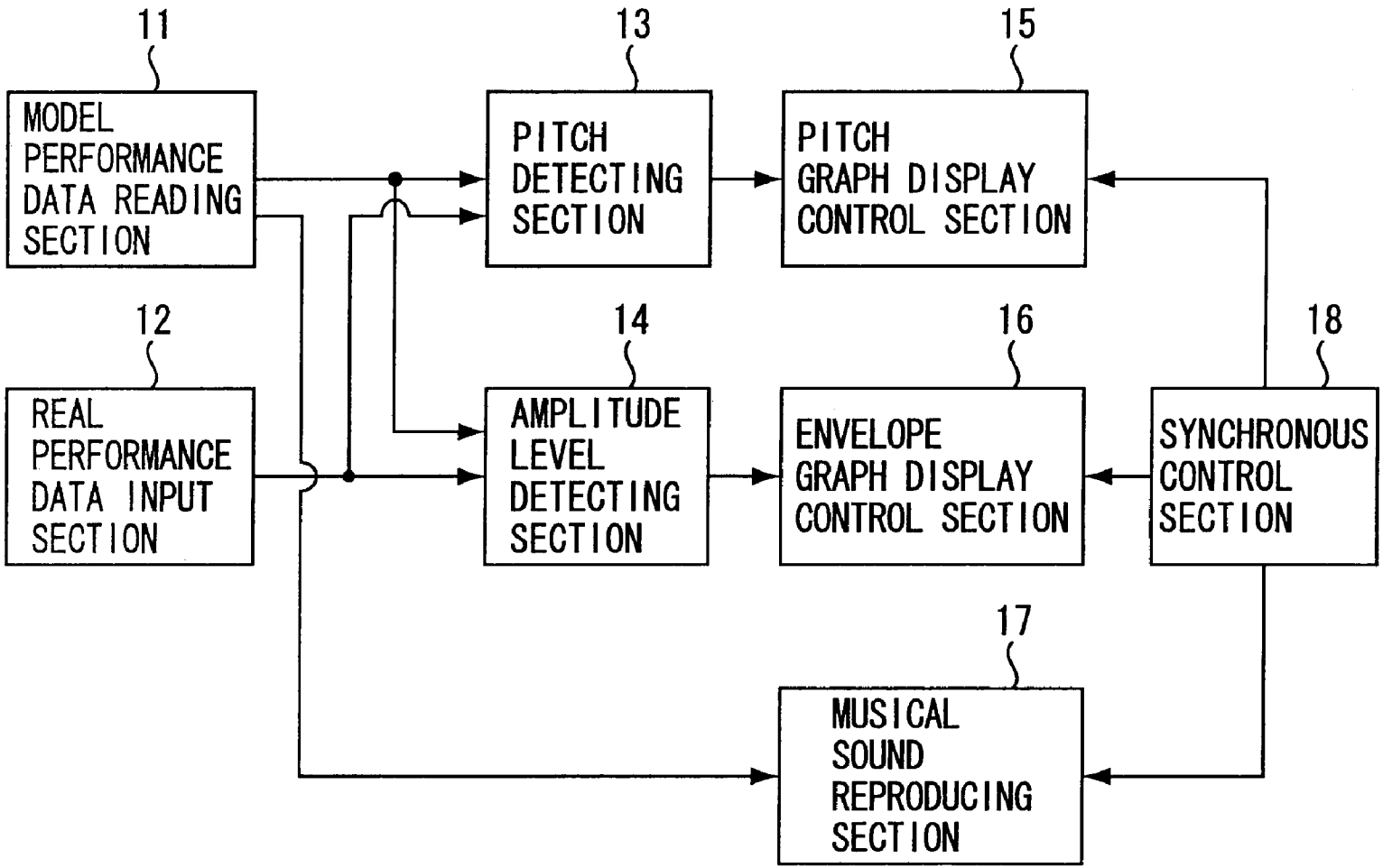
FIG. 2 is a logical construction diagram of the sections of the inventive apparatus controlled by a CPU.

As shown in FIG. 2, the CPU 1 logically controls a model performance data reading section 11, a real performance data input section 12, a pitch detecting section 13, an amplitude level detecting section 14, a pitch graph display control section 15, an envelope graph display control section 16, a musical sound reproducing section 17, and a synchronous control section 18 by executing the instrument performance learning program 5*a* in the hard disk 5 with the use of the RAM 4 as a work memory.

The model performance data reading section 11 controls the read-in drive 7 to read out model performance waveform data from a storage medium inserted into the read-in drive 7 and to store it into the hard disk 5. The hard disk 5 stores model performance waveform data of a plurality of numbers read by the model performance data reading section 11. The term "model performance waveform data" means data representing a series of time waveforms of performance sounds of the model performance.

Real performance waveform data is sequentially input from the real performance data input section 12. The term "real performance waveform data" means data representing time waveforms acquired by collecting performance sounds of a real performance using the microphone 8.

The pitch detecting section 13 detects pitches from both of the model performance waveform data and the real performance waveform data and supplies the detected pitches to the pitch graph display control section 15. Each of the pitches is detected in the procedure described below. First, input waveform data of a given time length is stored in a buffer. Subsequently, the stored waveform data is input to a low-pass filter and a high-pass filter for a removal of noise components. Thereafter, a pitch is detected from the zero-crossing count of waveform components that successfully passed the both filters. In this embodiment, noise components are removed from the waveform data by universally using a pair of filters, a low-pass filter and a high-pass filter, having cutoff frequencies previously fixed.

The pitch graph display control section 15 individually generates a pitch graph showing a relation between the performance elapsed time and the transition of the pitch for each of the model performance and the real performance. It then displays the pitch graphs in such a way that one is superimposed on the other on the computer display 6.

The amplitude level detecting section 14 detects amplitude levels from both of the model performance waveform data and the real performance waveform data and supplies the detected amplitude levels to the envelope graph display control section 16.

The envelope graph display control section 16 individually generates an amplitude envelope graph showing a relation between the performance elapsed time and the amplitude envelope for each of the model performance and the real performance. It then displays the amplitude envelope graphs in such a way that one is superimposed on the other on the computer display 6.

The musical sound reproducing section 7 synthesizes performance sounds of the model performance on the basis of the model performance waveform data and produces the sound from the speaker 9.

The synchronous control section 18 supports synchronization of the pitch graph display control section 15, the envelope graph display control section 16, and the musical sound reproducing section 17 by supplying a signal indicating the current performance elapsed time to these sections.

Subsequently, the operation of this embodiment will be described below.

The operation of this embodiment is divided into model performance graph plotting and real performance graph plotting.

Figure 3:
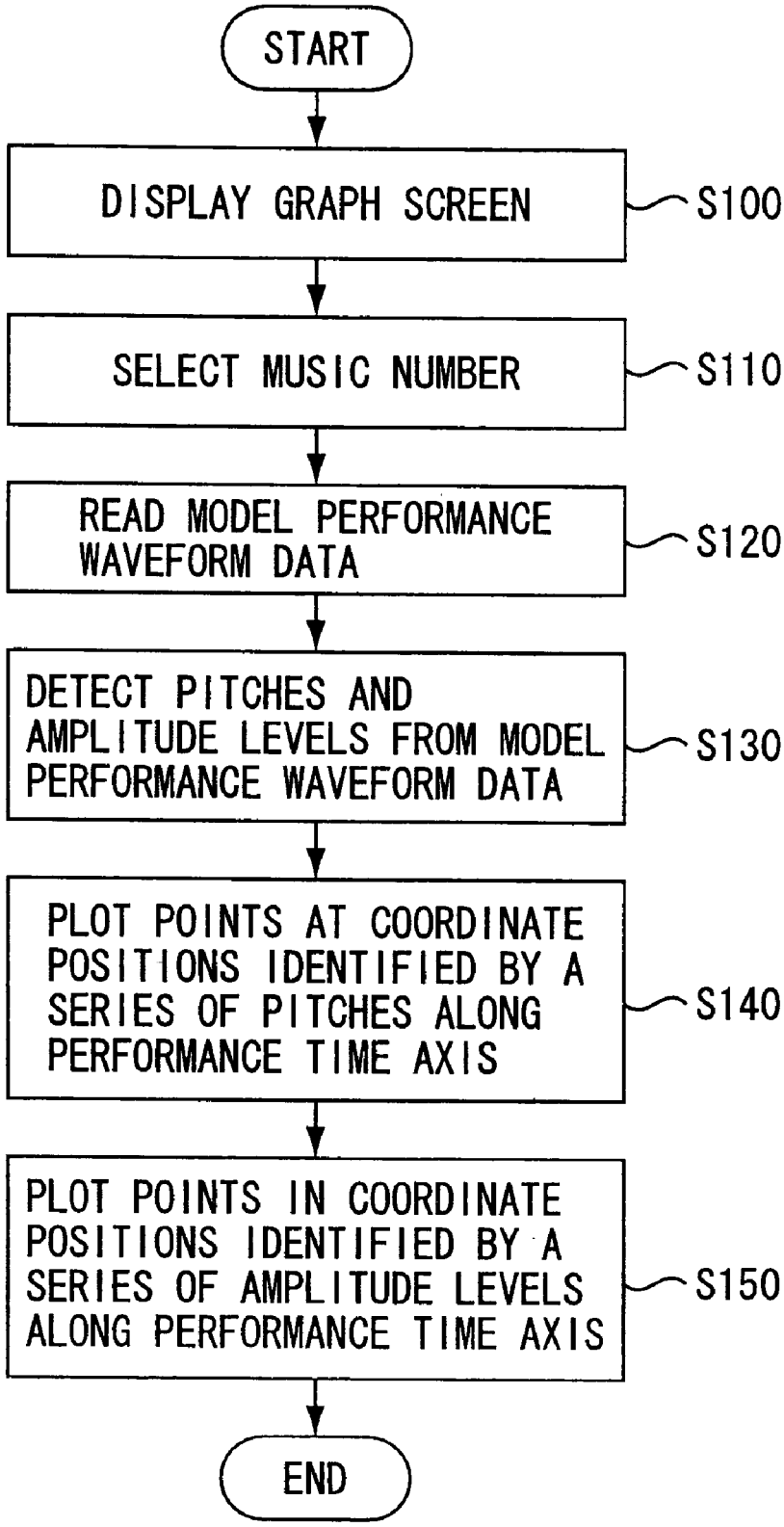
FIG. 3 is a flowchart illustrating model performance graph plotting process.

Referring to FIG. 3, there is shown a flowchart illustrating the operation of the model performance graph plotting.

In step 100 in FIG. 3, a graph screen is displayed on the computer display 6.

Figure 4:
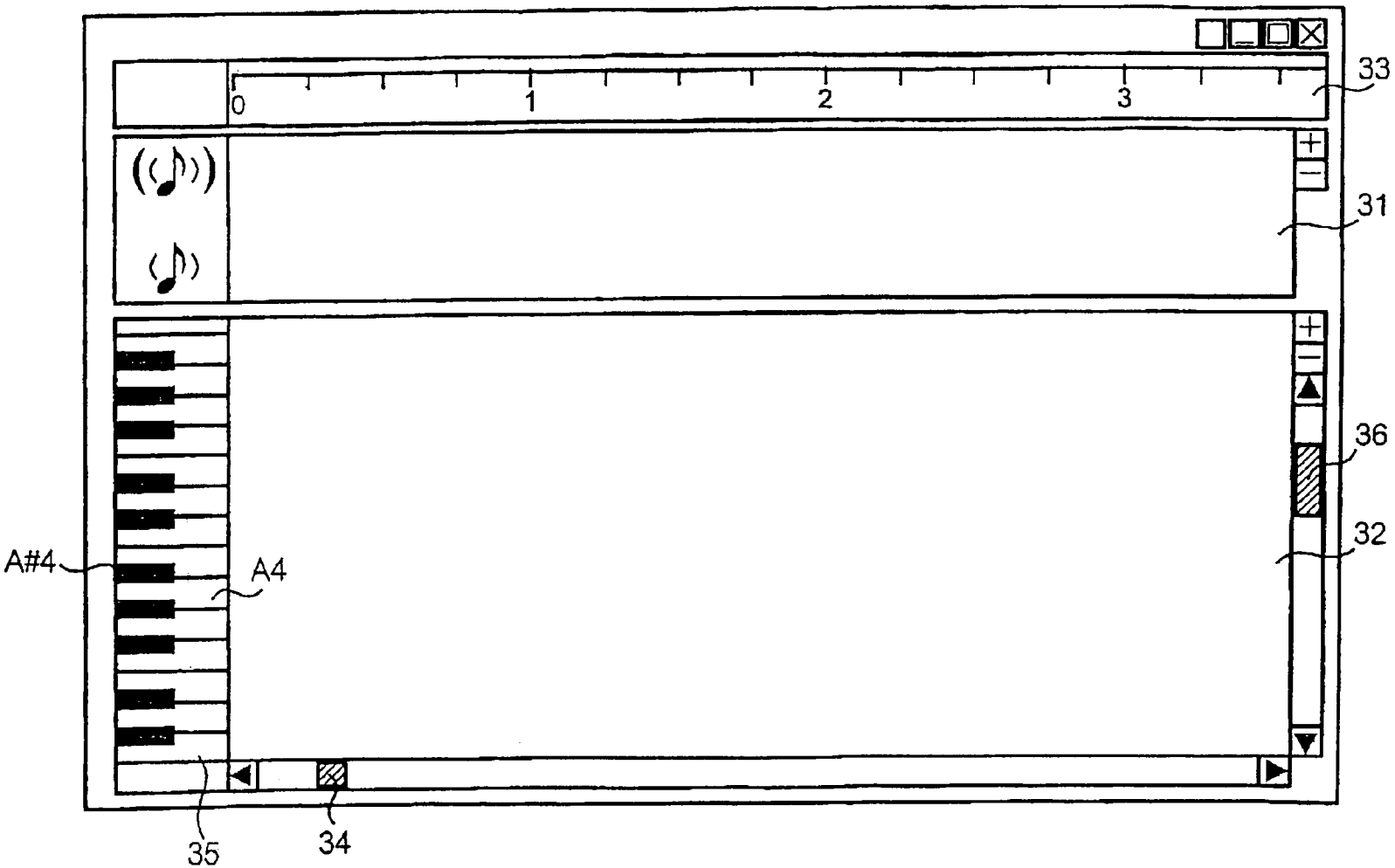
FIG. 4 is a graph screen.

Referring to FIG. 4, there is shown a graph screen that appears immediately after the execution of step 100. The graph screen includes an envelope graph display area 31 and a pitch graph display area 32. At the top of the envelope graph display area 31, a scale 33 is displayed for an indication of a performance elapsed time.

At the bottom of the pitch graph display area 32, a horizontal-axis scroll bar 34 is provided. By moving a mouse pointer via dragging on the scroll bar 34, the contents of drawings in the envelope graph display area 31 and the pitch graph display area 32 are horizontally scrolled together with the scale 33.

Moreover, an image 35 of a mock keyboard of a piano is vertically arranged as a scale indicating pitches on the left side of the pitch graph display area 32. Hereinafter, each key of the keyboard is called by a sound name based on the key of C.

In this embodiment, the center position of the vertical width of each key is matched with a pitch level calculated for each sound name based on the key of C according to the equal temperament of 12 degrees with the reference pitch of 440 Hz. For example, the center position of the vertical width of the key A4 in FIG. 4 coincides with the reference pitch 440 Hz and the center position of the vertical width of the next-upper key A#4 coincides with the pitch that is 100 cents higher than 440 Hz.

A vertical-axis scroll bar 36 is provided in the right side of the pitch graph display area 32. By moving a mouse pointer via dragging on the scroll bar 36, the contents of drawings in the pitch graph display area 32 are vertically scrolled together with the keyboard image 35.

After the graph screen shown in FIG. 4 appears on the computer display 6, a learner performs the operation of selecting a desired music number (S110). In response to the operation of selecting the number, model performance waveform data of the selected number is read out to the RAM 4 from the hard disk 5 (S120).

In step 130, pitches and amplitude levels of a model performance are sequentially detected from the model performance waveform data in the order of progress of the performance. In this step, the pitch detecting section 13 detects the pitches, while the amplitude level detecting section 14 detects the amplitude levels.

Subsequently, the pitch graph display control section 15 plots points at coordinate positions in the pitch graph display area 32 identified by a series of pitches detected from the model performance waveform data along the performance elapsed time (S140). Through the execution of this step, a curve showing the transition of the pitch of the model performance is drawn in the pitch graph display area 32.

Furthermore, the envelope graph display control section 16 plots points at coordinate positions in the envelope graph display area 31 identified by a series of amplitude levels detected from the model performance waveform data along the performance elapsed time (S150). Through the execution of this step, a curve showing the amplitude envelope of amplitude levels of the model performance is drawn in the envelope graph display area 31.

Figure 5:
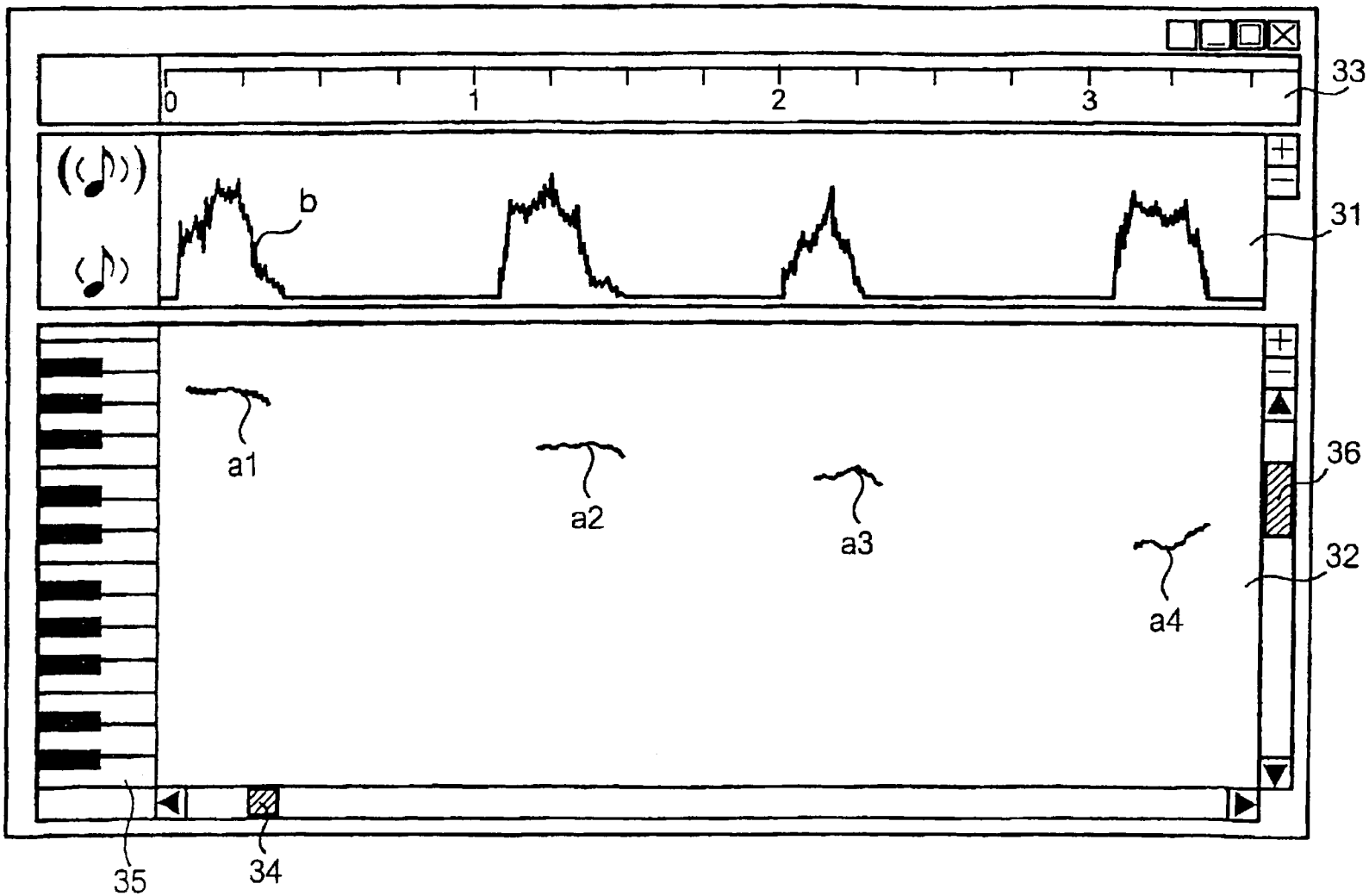
FIG. 5 is a graph screen.

Referring to FIG. 5, there is shown a graph screen that appears immediately after the execution of step 150. Curves a1 to a4 shown in this diagram represent the transitions of the pitches of performance sounds constituting the model performance and curve b represents an amplitude envelope of the time waveform of the model performance. Although the curves from the start of the performance to the middle of the fourth measure have been drawn on the graph screen in FIG. 5, the screen can be scrolled up to the subsequent performance elapsed time by controlling the horizontal-axis scroll bar 34.

If the learner performs the operation of giving notice of starting a real performance with the graph screen shown in FIG. 5 kept displayed on the computer display 6, real performance graph plotting is started.

Figure 6:
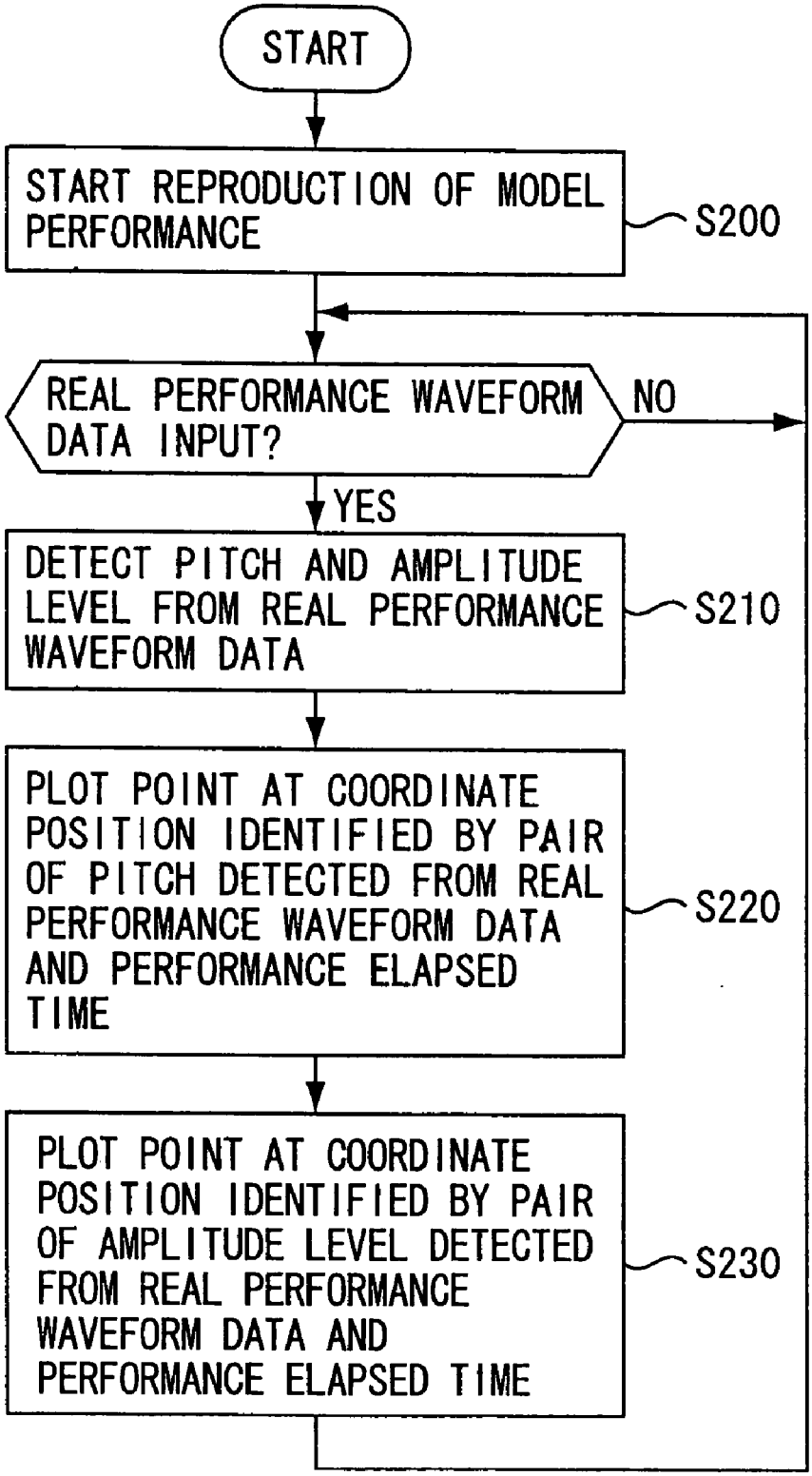
FIG. 6 is a flowchart illustrating real performance graph plotting process.

Referring to FIG. 6, there is shown a flowchart of the real performance graph plotting.

In step 200 in this diagram, reproduction of the model performance is started. More specifically, the musical sound reproducing section 17 sequentially produces performance sounds synthesized from the model performance waveform data from the speaker 9 in line with the elapse of the performance elapsed time with the support of the synchronous control section 18.

The learner does a real performance while listening to the performance sounds produced from the speaker 9. More specifically, the learner plays his or her instrument in such a way as to make the same volume or pitches as those of the produced performance sounds. If the microphone 8 collects the performance sound of the real performance, real performance waveform data representing the time waveform of the performance sound is input from the real performance data input section 12.

Upon the input of the real performance waveform data, the control progresses to step 210, where a pitch and an amplitude level are detected from the input real performance waveform data. The pitch detecting section 13 detects the pitch, while the amplitude level detecting section 14 detects the amplitude level. The detected pitch is immediately supplied to the pitch graph display control section 15 and the amplitude level is immediately supplied to the envelope graph display control section 16.

Subsequently, the pitch graph display control section 15 plots a point at the coordinate position in the pitch graph display area 32 identified by a pair of the pitch detected from the real performance waveform data and the current performance elapsed time (S220).

Furthermore, the envelope graph display control section 16 plots a point at the coordinate positions in the envelope graph display area 31 identified by a pair of the amplitude level detected from the real performance waveform data and the current performance elapsed time (S230).

The processes of steps 210 to 230 are executed every time the real performance waveform data is input from the real performance data input section 12, whereby a curve showing the transition of the pitch of the real performance is drawn and superimposed on a curve showing the transition of the pitch of the model performance in the pitch graph display area 32 of the graph screen. Moreover, a curve showing the amplitude envelope of the real performance is drawn and superimposed on a curve showing the amplitude envelope of the model performance in the envelope graph display area 31 of the graph screen.

Figure 7:
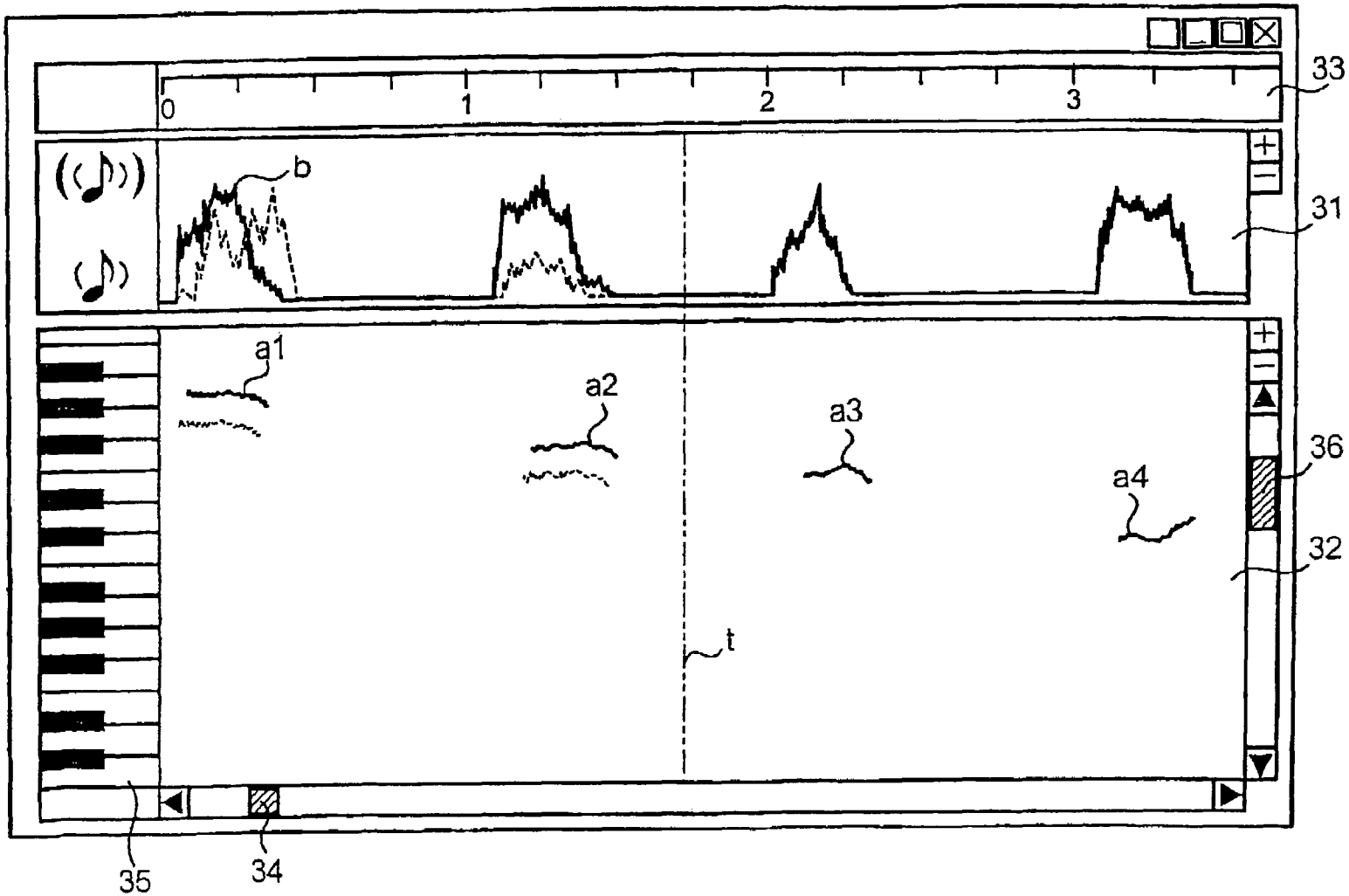
FIG. 7 is a graph screen.

Referring to FIG. 7, there is shown a graph screen that appears immediately after the execution of step 230 regarding the real performance waveform data at a certain performance elapsed time. A chain line t in FIG. 7 indicates a time axis of the current performance elapsed time. Curves (indicated by dashed lines in the diagram) each showing the transition of the pitch of a performance sound of the real performance are drawn in the vicinity of curves a1 and a2 each showing the transition of the pitch of a performance sound of the model performance in the left side of the chain line t in the pitch graph display area 32 in this diagram. Furthermore, a curve b showing an amplitude envelope of the model performance and a curve (indicated by a dashed line in this diagram) showing an amplitude envelope of the real performance are drawn in such a way that one is superimposed on the other in the left side of the chain line t in the envelope graph display area 31 in this diagram.

In the embodiment described hereinabove, the instrument performance learning apparatus displays a graph showing a difference between the transition of the pitch detected from the model performance waveform data and the transition of the pitch detected from the real performance waveform data in the pitch graph display area 32. Furthermore, it plots a graph showing a difference between the amplitude envelope of the amplitude levels acquired from the model performance waveform data and the amplitude envelope of the amplitude levels acquired from the real performance waveform data in the envelope graph display area 31. In this manner, the instrument performance learning apparatus presents not only a difference in pitch transition between the model performance and the real performance in the form of a graph, but also a difference in variation of the amplitude envelope between them in the form of a graph, thereby enabling a learner to easily grasp a difference in musical elements that cannot be represented only by pitches.

Moreover, the pitch graph display area 32 includes the piano roll image made of vertically arranged piano keys as a scale indicating pitch levels. Thus, the learner can intuitively recognize pitch levels from the relation between a curve drawn as a graph in this area and the positions of the keys.

Second Embodiment

A second embodiment of the present invention will be described below. In the first embodiment, the curves showing the transition of the pitch and the amplitude envelope of the model performance have been drawn before starting the real performance. In this embodiment, however, these curves are not previously drawn, but they are drawn in real time in line with the progress of the real performance.

The hardware configuration of the instrument performance learning apparatus according to this embodiment and the logical construction of the sections controlled by a CPU 1 are the same as those of the first embodiment. Therefore, their description is omitted here.

Figure 8:
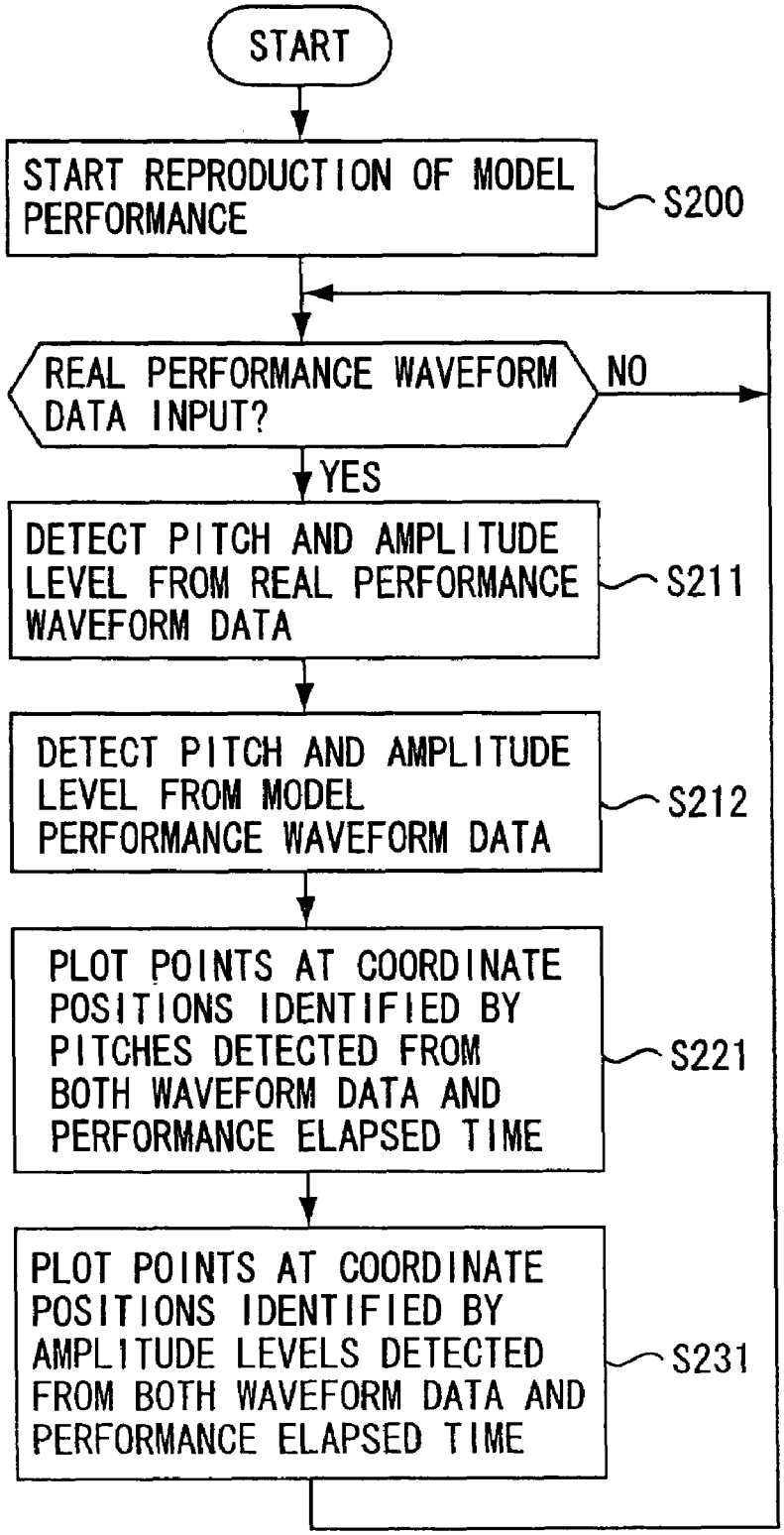
FIG. 8 is a flowchart illustrating the operation of a second embodiment.

Referring to FIG. 8, there is shown a flowchart illustrating the operation of this embodiment.

In step 200 in this diagram, reproduction of a model performance is started and performance sounds are sequentially produced from a speaker 9. Then, when a learner does a real performance while listening to the model performance, real performance waveform data representing the time waveform of the performance sound is input from a real performance data input section 12.

Upon the input of the real performance waveform data, a pitch and an amplitude level are detected from the input real performance waveform data (S211). Furthermore, the pitch and amplitude level in the performance portion corresponding to the current performance elapsed time are detected from model performance waveform data, too (S212).

In step 221, a pitch graph display control section 15 plots points in two coordinate positions in a pitch graph display area 32 identified by the pitches detected from the real performance waveform data and the model performance waveform data and the current performance elapsed time.

In step 231, an envelope graph display control section 16 plots points in two coordinate positions in an envelope graph display area 31 identified by the amplitude levels detected from the real performance waveform data and the model performance waveform data and the current performance elapsed time.

The processes of steps 211 to 231 are executed every time real performance waveform data is input from the real performance data input section 12, whereby a curve showing the transition of the pitch of the model performance and a curve showing the transition of the pitch of the real performance up to the current performance elapsed time are drawn in the pitch graph display area 32 of the graph screen. Moreover, a curve showing an amplitude envelope of the model performance and a curve showing an amplitude envelope of the real performance up to the current performance elapsed time are drawn in the envelope graph display area 31 of the graph screen.

Figure 9:
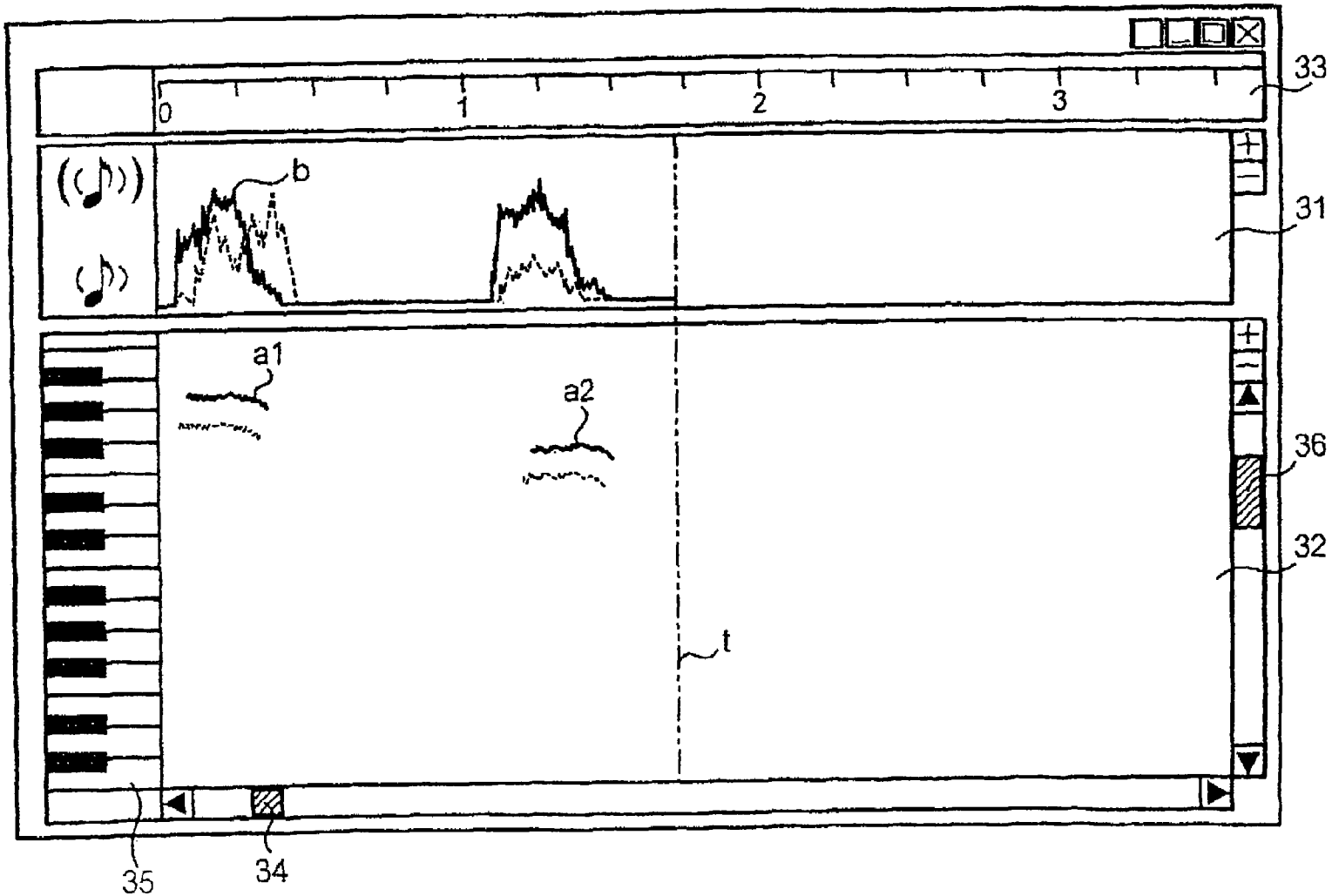
FIG. 9 is a graph screen.

Referring to FIG. 9, there is shown a graph screen that appears immediately after the execution of step 231 regarding the real performance waveform data at a certain performance elapsed time. A chain line t in this diagram indicates a time axis of the current performance elapsed time. Curves (indicated by dashed lines in this diagram) each showing the transition of the pitch of a performance sound of the real performance are drawn in the vicinity of curves a1 and a2 each showing the transition of the pitch of a performance sound of the model performance in the left side of the chain line t in the pitch graph display area 32 in this diagram. On the other hand, unlike FIG. 7, curves each showing the transition of the pitch of a performance sound of the model performance have not been drawn yet in the right side of the chain line 5. Moreover, a curve b showing the amplitude envelope of the model performance and a curve showing an amplitude envelope of the real performance (indicated by a dashed line in this diagram) are drawn in such a way that one is superimposed on the other in the left side of the chain line t in the envelope graph display area 31 in this diagram. There is, however, no drawing of a curve showing the amplitude envelope of the model performance in the right side of the chain line t.

According to the embodiment described hereinabove, the curves showing the transition of the pitch and the amplitude envelope of the model performance are drawn simultaneously in line with the progress of the real performance, thereby enabling the learner to clearly recognize the current section of the real performance.

Third Embodiment

A third embodiment of the present invention will be described below. In the above embodiments, the pitch detected from the real performance waveform data has always been plotted in the pitch graph display area 32. On the other hand, in this embodiment, if an amplitude level detected from the real performance waveform data is lower than a given value, the pitch detected along with the amplitude level is masked without plotting in a pitch graph display area 32.

The hardware configuration of the instrument performance learning apparatus according to this embodiment and the logical construction of the sections controlled by a CPU 1 are the same as those of the first embodiment. Therefore, their description is omitted here.

Subsequently, the operation of this embodiment will be described below.

The operation of this embodiment is divided into model performance graph plotting and real performance graph plotting. The content of the model performance graph plotting in these processes is the same as that of the first embodiment.

Figure 10:
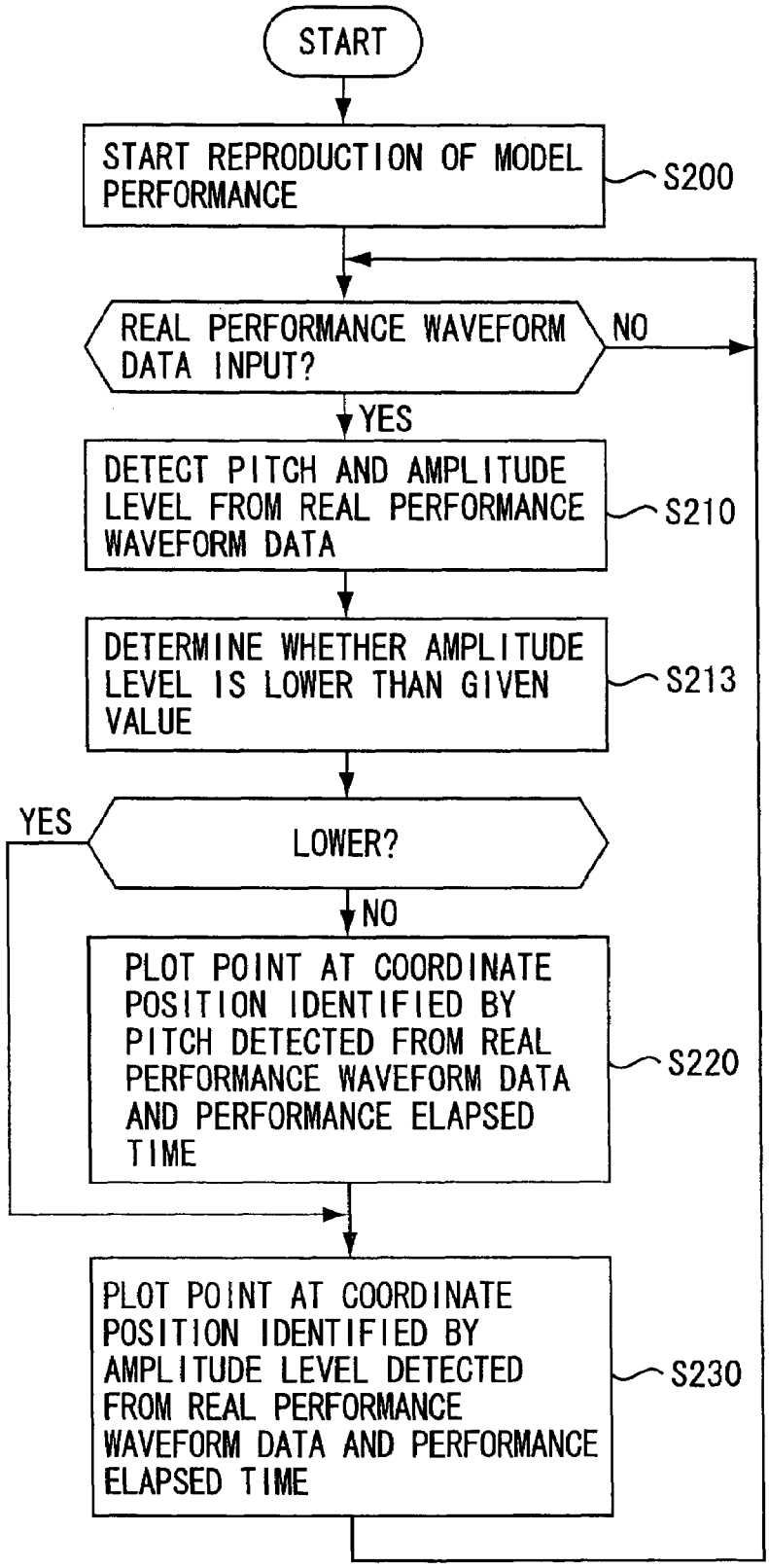
FIG. 10 is a flowchart illustrating real performance graph plotting process.

Referring to FIG. 10, there is shown a flowchart illustrating real performance graph plotting according to this embodiment. The processing shown in this diagram is the same as that in FIG. 6 except that step 213 is put between step 210 and step 220. In step 213, it is determined whether the amplitude level detected from the real performance waveform data in step 210 is lower than the given value. If the result of the determination is "NO" in step 213, the control progresses to step 220. If it is "YES" in step 213, the control progresses to step 230 bypassing step 220.

Figure 11:
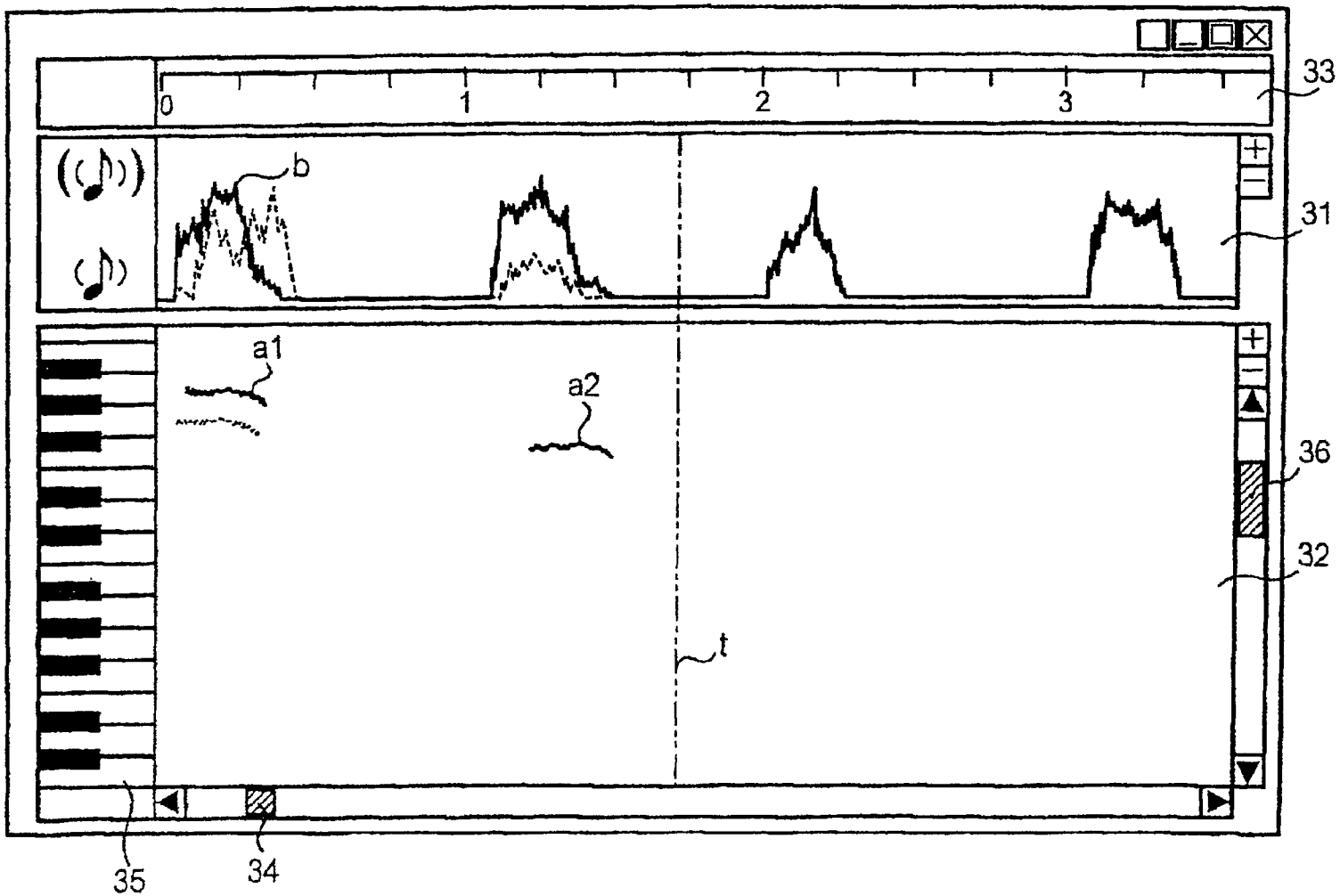
FIG. 11 is a graph screen showing the transition of pitches of the real performance and the amplitude spectrum.

Referring to FIG. 11, there is shown a graph screen that appears immediately after the execution of step 230 regarding the real performance waveform data at a certain elapsed time. A chain line t in this diagram indicates a time axis at the current performance elapsed time. In the left side of the chain line t in the pitch graph display area 32 in this diagram, curves each showing the transition of the pitch of a performance sound of the real performance are supposed to be drawn in the vicinity of curves a1 and a2. There is, however, no drawing of the curve in the vicinity of the curve a2. This means that the process of step 220 is bypassed since the amplitude level detected from the real performance waveform data is lower than the given value and the result in step 213 is determined "YES."

According to the embodiment described hereinabove, if the amplitude level detected from the real performance waveform data is lower than the given value, the pitch detected along with the amplitude level is masked without plotting in the pitch graph display area 32. Therefore, the learner can understand immediately that the intensity of his or her performance sound has been insufficient, simply by referencing the content of the pitch graph display area 32.

Fourth Embodiment

A fourth embodiment of the present invention will be described below. In the above embodiments, the pitch scale indicated by the keyboard has been fixed in the pitch graph display area 32. On the other hand, in this embodiment, the pitch scale indicated by the keyboard in the pitch graph display area 32 is dynamically changeable according to the type of instrument played in a real performance.

The hardware configuration of the instrument performance learning apparatus according to this embodiment is the same as that of the first embodiment. Therefore, its description is omitted here.

Figure 12:
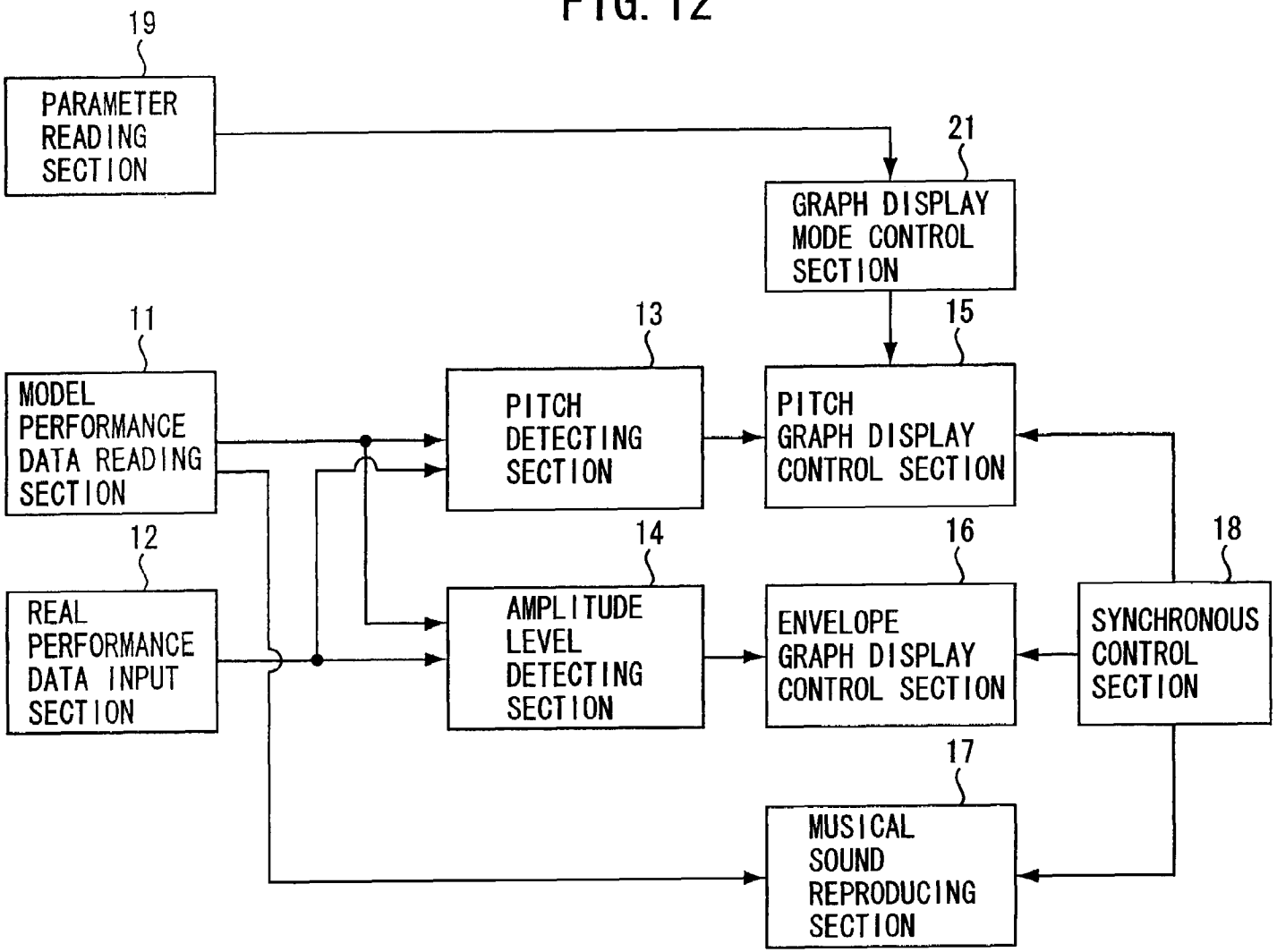
FIG. 12 is a logical construction diagram of the sections of the inventive apparatus controlled by a CPU.

Referring to FIG. 12, there is shown a block diagram of a logical construction of the sections controlled by a CPU 1. The CPU 1 in this embodiment controls a model performance data reading section 11, a real performance data input section 12, a pitch detecting section 13, an amplitude level detecting section 14, a pitch graph display control section 15, an envelope graph display control section 16, a musical sound reproducing section 17, a synchronous control section 18, a parameter reading section 19, and a graph display mode control section 20.

The parameter reading section 19 reads out a graph display mode parameter from a storage medium inserted into a read-in drive 7 by controlling the read-in drive 7 and stores it into a hard disk 5. The hard disk 5 stores the graph display mode parameter for each type of instrument read by the parameter reading section 19.

The term "graph display mode parameter" means a parameter that defines a frequency value of a reference pitch for the equal temperament of 12 degrees and a key matched with the reference pitch. Although the frequency value of the reference pitch is set to 440 Hz in general, a frequency value other than that may be set, too. In addition, most instruments are tuned in the key of C and the reference pitch is generally matched with the key A4. For a transposing instrument, however, the reference pitch may be matched with a key other than the key A4. For example, for a B-flat brass trumpet, it is preferable to match the key generating the pitch of the reference frequency with the key B4, which is two halftones higher than the key A4, and to set the graph display in the two-halftone higher position.

The graph display mode control section 20 reads out a graph display mode parameter from the hard disk 5 and changes a correspondence between the keys in the pitch graph display area 32 and the pitch levels indicated by the keys according to the content of the parameter having been read out.

The operation of this embodiment is divided into model performance graph plotting and real performance graph plotting. The content of the real performance graph plotting in these processes is the same as that of the first embodiment.

On the other hand, the model performance graph plotting of this embodiment includes pitch scale setting processing as preprocessing of step 100.

Figure 13:
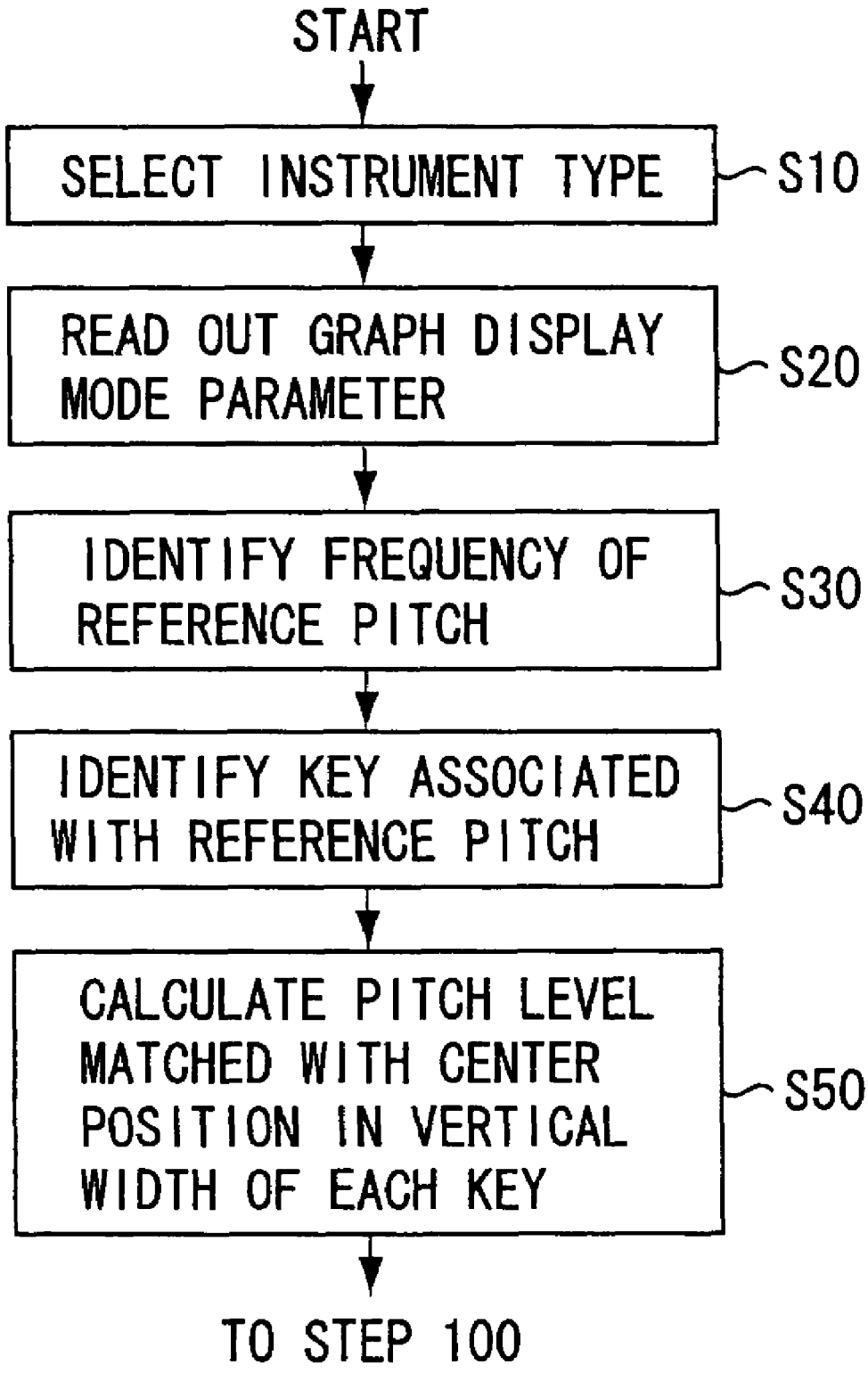
FIG. 13 is a flowchart illustrating pitch scale setting process.

Referring to FIG. 13, there is shown a flowchart of pitch scale setting processing.

In step 10 shown in this chart, a learner selects the type of instrument he or she learns to play.

Upon the selection of the instrument type, the graph display mode control section 20 reads out the graph display mode parameter corresponding to the selected type from the hard disk 5 to a RAM 4 (S20).

The graph display mode control section 20 identifies the frequency of the reference pitch from the read graph display mode parameter (S30). Furthermore, in the next step 40, it identifies the key associated with the reference pitch from the graph display mode parameter.

In step 50, the graph display mode control section 20 calculates pitch levels matched with the center positions of the vertical widths of the keys of the keyboard in the pitch graph display area 32 on the basis of the frequency of the reference pitch identified in step 30 and the key identified in step 40.

In the next step 100, a graph screen reflecting the result of the calculation in step 50 appears on a computer display 6.

According to this embodiment described hereinabove, the pitch scale indicated by the keyboard in the pitch graph display area 32 is dynamically changeable according to the type of instrument to be played in a real performance. Therefore, a user can learn to play also an instrument tuned in the key other than the key of C smoothly.

Fifth Embodiment

A fifth embodiment of the present invention will be described below.

In the aforementioned embodiment, the pitch detecting section 13 has removed noise components from the waveform data only by using the pair of filters, a low-pass filter and a high-pass filter, having cutoff frequencies previously fixed. On the other hand, in this embodiment, the cutoff frequency of the low-pass filter and that of the high-pass filter for use in removing the noise components are dynamically changeable according to the type of instrument to be played in a real performance.

The hardware configuration of the instrument performance learning apparatus according to this embodiment is the same as that of the first embodiment. Therefore, its description is omitted here.

Figure 14:
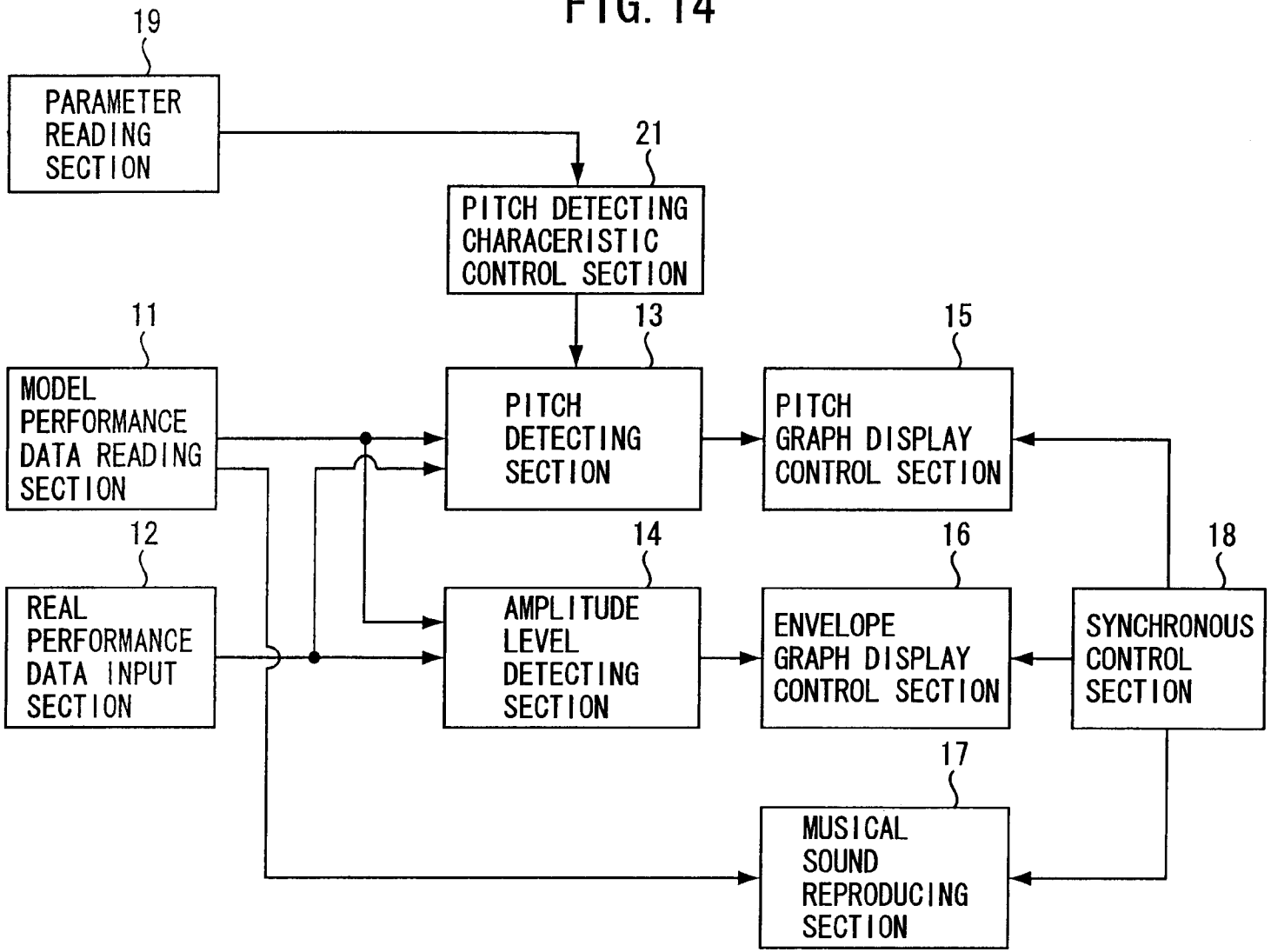
FIG. 14 is a logical construction diagram of the sections of the inventive apparatus controlled by a CPU.

Referring to FIG. 14, there is shown a block diagram illustrating a logical construction of the sections controlled by a CPU 1. The CPU 1 in this embodiment controls a model performance data reading section 11, a real performance data input section 12, a pitch detecting section 13, an amplitude level detecting section 14, a pitch graph display control section 15, an envelope graph display control section 16, a musical sound reproducing section 17, a synchronous control section 18, a parameter reading section 19, and a pitch detecting characteristic control section 21.

The parameter reading section 19 reads out a pitch detecting characteristic parameter from a storage medium inserted into a read-in drive 7 by controlling the read-in drive 7 and stores it into a hard disk 5. The hard disk 5 stores a pitch detecting characteristic parameter for each type of instrument read by the parameter reading section 19.

The term "pitch detecting characteristic parameter" means a parameter that defines a value of the cutoff frequency of the high-pass filter and a value of the cutoff frequency of the low-pass filter.

The pitch detecting characteristic control section 21 reads out a pitch detecting characteristic parameter from the hard disk 5 and changes a pitch detecting characteristic of the pitch detecting section 13 according to the content of the parameter having been read out.

The operation of this embodiment is divided into model performance graph plotting and real performance graph plotting. The content of the real performance graph plotting in these processes is the same as that of the first embodiment.

On the other hand, the model performance graph plotting of this embodiment includes pitch detecting characteristic setting processing as preprocessing of step 100.

Figure 15:
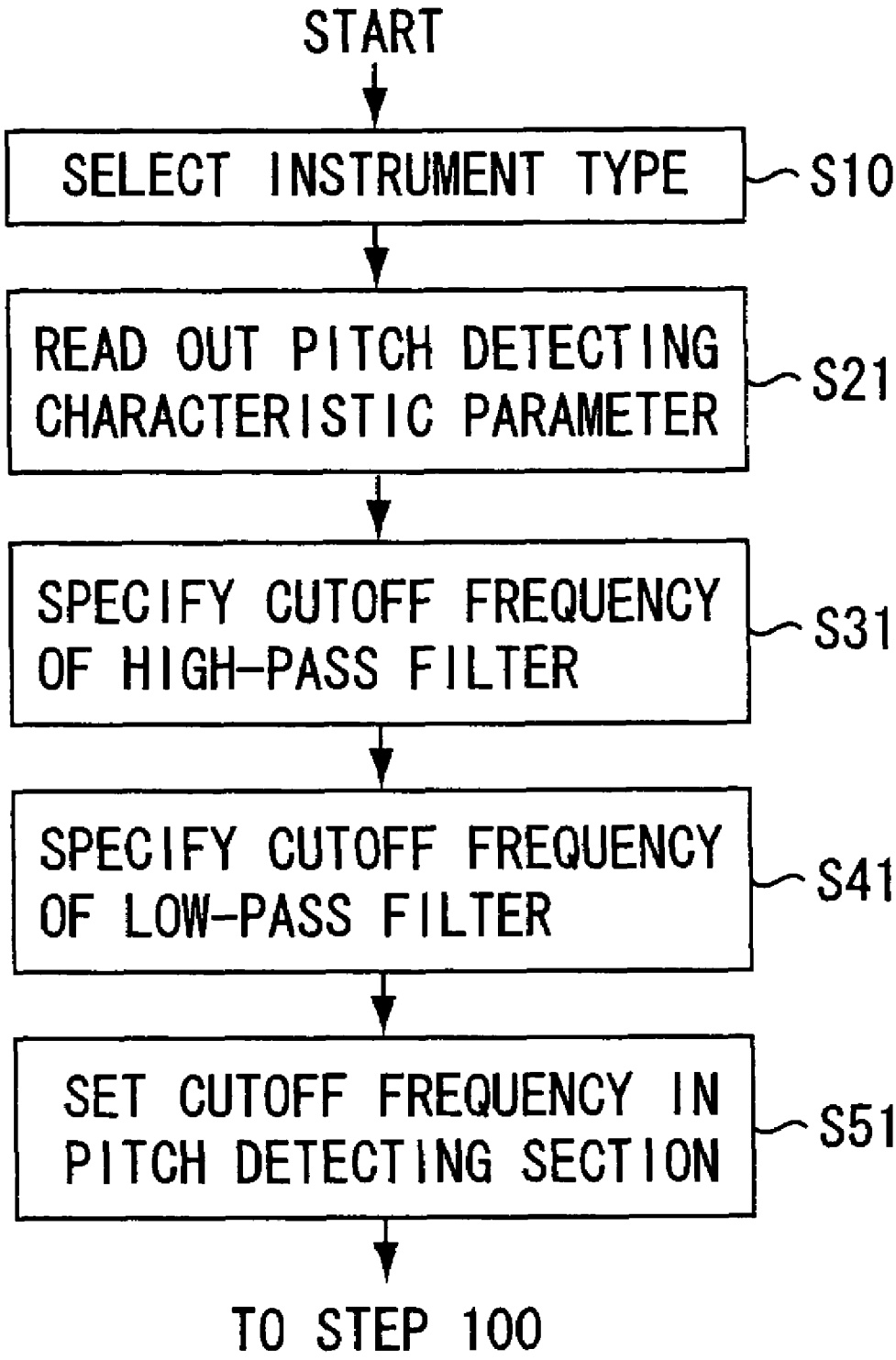
FIG. 15 is a flowchart illustrating pitch detecting characteristic setting process.

Referring to FIG. 15, there is shown a flowchart of pitch detecting characteristic setting processing.

In step 10 shown in this chart, a learner selects the type of instrument he or she learns to play.

Upon the selection of the instrument type, the pitch detecting characteristic control section 21 reads out the pitch detecting characteristic parameter corresponding to the selected type from the hard disk 5 to a RAM 4 (S21).

The pitch detecting characteristic control section 21 specifies identifies the cutoff frequency of the high-pass filter from the graph display mode parameter (S31). Furthermore, in the next step 41, it specifies the cutoff frequency of the low-pass filter from the graph display mode parameter.

In step 51, the pitch detecting characteristic control section 21 sets the both cutoff frequencies identified in step 31 and step 41 in the pitch detecting section 13.

In the embodiment described hereinabove, the cutoff frequency of the low-pass filter and that of the high-pass filter are dynamically changeable according to the type of instrument to be played in the real performance. Therefore, it is possible to achieve very reliable pitch detection based on the feature of tones of the instrument to be played in the real performance.

Other Embodiments

Various changes and modifications may be made in the present invention.

The present invention may be configured in such a way that a user can increase or decrease the display resolution of the pitch graph display area 32 of the graph screen, in other words, the range of the keyboard that can be viewed without vertically scrolling the area. According to this modification, this system can be used as a tuner by referencing the fluctuation of a curve drawn in the pitch graph display area 32, for example, which results from increasing the display resolution until only a specific key (for example, the key A4) is displayed in the pitch graph display area 32 and producing the pitch sound corresponding to the specific key in a real performance.

While the pitch detecting section 13 has removed noise components from the waveform data of the given time length and then detected a pitch from the zero-crossing count of the remaining waveform components, the method of detecting a pitch is not limited to this. For example, a pitch may be detected by detecting peaks of a waveform from the waveform components and measuring an interval between the detected peaks.

In the above embodiment, the musical sound reproducing section 17 has produced performance sounds synthesized from the model performance waveform data from the speaker 9 in line with the elapse of the performance elapsed time. On the other hand, it is also possible to prepare score data of a model performance separately from the model performance waveform data and display a score image generated from the score data in line with the elapse of the performance elapsed time or to prepare video image data of a model performer doing the model performance and display video images generated from the video image data in line with the elapse of the performance elapsed time. In this regard, it is also possible to inhibit the performance sounds synthesized from the model performance waveform data from being produced from the speaker 9.

In step 212 in the second embodiment, the pitch and the amplitude level in the performance portion corresponding to the current performance elapsed time have been detected from the model performance waveform data. On the other hand, in this step 212, a pitch and an amplitude level in a performance portion a given time length ahead of the current performance elapsed time may be detected from the model performance waveform data. If this processing is performed, the pitch graph display area 32 and the envelope graph display area 31 always display pitches and amplitude levels of the model performance the given time length ahead of the current performance elapsed time continuously. Thereby, a learner can grasp the content of pitches and amplitude levels of the model performance before the real performance of the corresponding performance portion, whereby the learner can learn the model performance more easily.

In the third embodiment, if the amplitude level detected from the input real performance waveform data is lower than the given value, the pitch detected along with the amplitude level is masked. On the other hand, the pitch may be masked if the input real performance waveform data satisfies other conditions. As these conditions, there are supposed to be conditions that the pitch detected from the real performance waveform data is unstable or that the pitch detected from the real performance waveform data of a performance portion goes out of a given frequency range associated with the sound name corresponding to the pitch detected from the model performance waveform data of the same performance portion, for example.

In the fourth embodiment, the frequency value of the reference pitch and the key matched with the reference pitch have been identified by using the graph display mode parameter read from the hard disk 5 and then pitch levels matched with other keys have been calculated based on the equal temperament of 12 degrees. On the other hand, the pitch levels matched with other keys can be calculated based on the just temperament. According to this modification, a learner can smoothly learn to play the kind of instrument that the learner would play for a chord performance. In other words, any pitch calculation method can be used only if the relation between the keys and the pitch levels indicated by the keys can be changed according to the content of the parameter prepared for each type of instrument.

In the fifth embodiment, the cutoff frequency of the low-pass filter and that of the high-pass filter of the pitch detecting section 13 are changeable according to the content of the pitch detecting characteristic parameter read from the hard disk 5. On the other hand, another pitch detecting characteristic of the pitch detecting section 13 may be changed according to the pitch detecting characteristic parameter. As another pitch detecting characteristic that can be changed according to the pitch detecting characteristic parameter, there will be a buffer length of a buffer for storing waveform data, for example.

In the above embodiments, the pitch detecting section 13 playing a role of detecting pitches from the model performance waveform data and the real performance waveform data has been separated from the pitch graph display control section 15 for plotting a graph of the detected pitches. The pitch graph control section 15, however, may also function as the pitch detecting section 13. Similarly, in the above embodiments, the amplitude level detecting section 14 has been separated from the envelope graph display control section 16. The envelope graph display device 16 may also function as the amplitude level detecting section 14.

In the above embodiments, a pitch as a characteristic feature of playing an instrument and an amplitude level as another characteristic feature have been extracted from the model performance waveform data and the real performance waveform data to display a pitch graph showing a difference in transition of pitches and an envelope graph showing a difference in amplitude envelope together. On the other hand, it is also possible to extract a characteristic value indicating a feature other than the amplitude level from the model performance waveform data and the real performance waveform data to display a graph showing a difference in transition of the extracted characteristic value.

Examples of preferable characteristic values for this modification are as described below.

There is an amplitude power envelope as a first example. By displaying the amplitude power envelope, a learner can bring the intensities of performance sounds in the real performance or senses given to listeners closer to the model performance.

There is a spectrum of a specific frequency component other than the fundamental frequency as a second example. For example, by displaying the transition of the spectrum of the largest harmonic overtone component excluding the fundamental frequency in the form of a graph, a learner can bring the tones of performance sounds in the real performance closer to the model performance. More preferably, the spectrum transition is displayed in the form of a graph showing the density of frequency components by means of a color density.

There is a characteristic value indicating a degree of smoothness in sound as a third example. This characteristic value can be detected by identifying a silent section of a time waveform represented by waveform data. By displaying the transition of the characteristic value indicating the smoothness in sound in the form of a graph, a learner can bring the smoothness of performance sounds in the real performance closer to the model performance.

There is a differential value of an amplitude envelope as a fourth example. More specifically, the transition of the slope of the amplitude envelope is displayed in the form of a graph. By displaying the graph, a learner can bring accentuation in each performance portion closer to the model performance.

There is a characteristic value representing a ratio of a harmonic overtone component to the fundamental frequency component as a fifth example. By displaying the transition of the ratio in the form of a graph, a learner can bring the tones of performance sounds in the real performance closer to the model performance.

There is a characteristic value indicating a harmonic component excluding the fundamental frequency component and the harmonic overtone component as a sixth example. The transition of this characteristic value may be displayed as the transition of a breath component in the form of a graph, so that a learner grasps the condition.

There is a characteristic value representing a difference between the pitch level of a performance sound and the pitch level indicated by the key corresponding to the performance sound as a seventh example. By displaying the transition of this characteristic value in the form of a graph, a learner can bring the pitches in the real performance closer to the model performance.

What is claimed is:

1. An instrument performance learning apparatus having a display device for displaying a progression of a real performance to enable visual comparison of the real performance with a model performance, the instrument performance learning apparatus comprising:

a storage section that stores model performance waveform data representing a time series of individual performance sounds of the model performance;

an input section that inputs real performance waveform data representing a time series of individual performance sounds of the real performance;

a first graph display control section that detects each pitch of each individual performance sound from the stored model performance waveform data and each pitch of each individual performance sound from the inputted real performance waveform data, and that displays a first graph presenting transitions of the pitches detected from both of the real performance waveform data and the model performance waveform data on the display device; and a second graph display control section that detects each characteristic value representing a characteristic of each individual performance sound of the model performance from the model performance waveform data and each characteristic value representing a characteristic of each individual performance sound of the real performance from the real performance waveform data, and that displays a second graph representing transitions of the characteristic values detected from both of the model performance waveform data and the real performance waveform data on the display device, such that the second graph has a time axis common to that of the first graph while the second graph is located in an area of the display device which does not overlap with another area of the display device where the first graph is located.

2. An instrument performance learning apparatus having a display device for displaying a progression of a real performance to enable visual comparison of the real performance with a model performance, the instrument performance learning apparatus comprising:

a storage section that stores model performance waveform data representing a time series of individual performance sounds of the model performance;

an input section that inputs real performance waveform data representing a time series of individual performance sounds of the real performance;

a pitch graph display control section that detects each pitch of each individual performance sound of the model performance from the stored model performance waveform data and each pitch of each individual performance sound of the real performance from the inputted real performance waveform data, and that displays a pitch graph representing transitions of the pitches detected from both of the model performance waveform data and the real performance waveform data on the display device; and an amplitude envelope graph display control section that detects each amplitude level of each individual performance sound of the model performance from the model performance waveform data and each amplitude level of each individual performance sound of the real performance from the real performance waveform data, and that displays an amplitude envelope graph representing transitions of the amplitude levels detected from both of the model performance waveform data and the real performance waveform data, such that the amplitude envelope graph has a time axis common to that of the pitch graph while the amplitude envelope graph is located in an area of the display device which does not overlap with another area of the display device where the pitch graph is located.

3. The instrument performance learning apparatus according to claim 2, wherein the pitch graph display control section detects pitches of all or a part of the individual performance sounds of the model performance from the stored model performance waveform data prior to the inputting of the real performance waveform data from the input section, and previously displays a pitch graph representing the transitions of the detected pitches on the display device, while the pitch graph display control section sequentially detects the pitches of the individual performance sounds of the real performance from the inputted real performance waveform data upon start of the inputting of the real performance waveform data from the input section, and the pitch graph display control section displays another pitch graph representing the transitions of the detected pitches of the individual performance sounds of the real performance on the display device in such a way that said another pitch graph of the real performance is superimposed on said pitch graph of the model performance previously displayed on the display device.

4. The instrument performance learning apparatus according to claim 3, wherein the pitch graph display control section inhibits a pitch detected from a certain portion of the real performance waveform data from being displayed on the display device if the certain portion of the real performance waveform data inputted from the input section meets a predetermined condition.

5. The instrument performance learning apparatus according to claim 4, wherein the predetermined condition is such that the amplitude level detected from the certain portion of the input real performance waveform data is lower than a predetermined value.

6. The instrument performance learning apparatus according to claim 4, wherein the predetermined condition is such that no pitch is detected from the certain portion of the inputted real performance waveform data.

7. The instrument performance learning apparatus according to claim 4, wherein the predetermined condition is such that the pitch detected from the certain portion of the inputted real performance waveform data is out of a frequency range associated with a sound name given to the certain portion.

8. The instrument performance learning apparatus according to claim 2, wherein the amplitude envelope graph display control section detects the amplitude levels of all or a part of the individual performance sounds of the model performance from the model performance waveform data prior to the inputting of the real performance waveform data from the input section, and previously displays an amplitude envelope graph representing the transitions of the detected amplitude levels of the model performance on the display device, while the amplitude envelope graph display control section sequentially detects the amplitude levels of the individual performance sounds of the real performance from the inputted real performance waveform data upon start of the inputting of the real performance waveform data from the input section, and the amplitude envelope graph display control section displays another amplitude envelope graph representing the transitions of the detected amplitude levels of the real performance on the display device in such a way that said another amplitude envelope graph of the real performance is superimposed on the previously displayed amplitude envelope graph of the model performance.

9. The instrument performance learning apparatus according to claim 2, further comprising a performance portion identifying section that identifies a portion of the model performance waveform data corresponding to a portion of the real performance waveform data currently inputted from the input section, wherein the pitch graph display control section detects a pitch from a portion of the real performance waveform data every time a portion of the real performance waveform data is inputted from the input section, the pitch graph display control section also detects a pitch from the corresponding portion of the model performance waveform data identified by the performance portion identifying section, and the pitch graph display control section plots the pitches detected from both of the real performance waveform data and the model performance waveform data in coordinate positions of a given display area of the display device, thereby drawing the pitch graph representing the transitions of the pitches detected from both of the real performance waveform data and the model performance waveform data in the given display area.

10. The instrument performance learning apparatus according to claim 9, wherein the pitch graph display control section inhibits a pitch detected from a certain portion of the real performance waveform data from being plotted in the coordinate position of the given display area if the certain portion of the real performance waveform data inputted from the input section meets a predetermined condition.

11. The instrument performance learning apparatus according to claim 10, wherein the predetermined condition is such that the amplitude level detected from the certain portion of the input real performance waveform data is lower than a predetermined value.

12. The instrument performance learning apparatus according to claim 10, wherein the predetermined condition is such that no pitch is detected from the certain portion of the inputted real performance waveform data.

13. The instrument performance learning apparatus according to claim 10, wherein the predetermined condition is such that the pitch detected from the certain portion of the inputted real performance waveform data is out of a frequency range associated with a sound name given to the certain portion.

14. The instrument performance learning apparatus according to claim 2, further comprising a performance portion identifying section that identifies a portion of the model performance waveform data corresponding to a portion of the real performance waveform data currently inputted from the input section, wherein the amplitude envelope graph display control section detects an amplitude level from a portion of the real performance waveform data every time a portion of the real performance waveform data is inputted from the input section, the amplitude envelope graph display control section also detects an amplitude level from the corresponding portion of the model performance waveform data identified by the performance portion identifying section, and the amplitude envelope graph display control section plots the amplitude levels detected from both of the real performance waveform data and the model performance waveform data in coordinate positions of a given display area of the display device, thereby drawing the amplitude envelope graph representing the transitions of the amplitude levels detected from both of the real performance waveform data and the model performance waveform data in the given display area.

15. The instrument performance learning apparatus according to claim 2, wherein the display device displays a piano roll image in the display device for presenting the pitch graph, the piano roll image being composed of a plurality of images of keys vertically arranged as a pitch scale.

16. The instrument performance learning apparatus according to claim 15, further comprising a parameter storage section that stores parameters defining different display modes of the pitch graph for different types of instruments, a type input section that inputs a type of an instrument to be used in the real performance, and a display mode control section that reads out the parameter associated with the type inputted from the type input section from the parameter storage section and that changes a correspondence between individual keys of the piano roll image and levels of the pitch indicated by the keys according to the parameter read out from the parameter storage section.

17. The instrument performance learning apparatus according to claim 2, further comprising a parameter storage section that stores parameters defining different pitch detecting characteristics for different types of instruments, a type input section that inputs the type of the instrument used in the real performance, and a detection characteristic control section that reads out the parameter associated with the type which is inputted by the type input section, from the parameter storage section, and that changes the pitch detecting characteristic of the pitch graph display control section according to the parameter read out from the parameter storage section.

18. A machine readable medium for use in a computer which has a display device, a storage device for storing model performance waveform data representing a time series of individual performance sounds of a model performance, and an input device for inputting real performance waveform data representing a time series of individual performance sounds of a real performance, the medium containing a program executable by the computer for carrying out an instrument performance learning method comprising:

a pitch graph display control step of detecting pitches of the individual performance sounds from the model performance waveform data and the real performance waveform data, and displaying a pitch graph representing transitions of the pitches detected from both of the model performance waveform data and the real performance waveform data on the display device; and an amplitude envelope graph display control step of detecting amplitude levels of the individual performance sounds from the model performance waveform data and the real performance waveform data, and displaying an amplitude envelope graph representing transitions of the amplitude levels detected from both of the model performance waveform data and the real performance waveform data, such that the amplitude envelope graph has a time axis common to that of the pitch graph while the amplitude envelope graph is located in an area of the display device which does not overlap with another area of the display device where the pitch graph is located.

* * * * *